United States Patent [19]

Lengyel

[11] Patent Number: 4,464,292

[45] Date of Patent: Aug. 7, 1984

[54] MIXED ETHOXYLATED ALCOHOL/ETHOXY SULFATE SURFACTANTS AND SYNTHETIC DETERGENTS INCORPORATING THE SAME

[76] Inventor: Stephen P. Lengyel, 456 Steeplechase La., Bridgewater, N.J. 08807

[21] Appl. No.: 222,076

[22] Filed: Jan. 2, 1981

[51] Int. Cl.[3] ..... C11D 1/83; C11D 3/08

[52] U.S. Cl. ..... 252/532; 252/551; 260/458 R

[58] Field of Search ..... 252/532, 551; 260/458 R

[56] References Cited

U.S. PATENT DOCUMENTS

| | | | |
|---|---|---|---|
| 2,941,950 | 6/1960 | Korpi et al. | 252/153 |
| 3,413,331 | 11/1968 | Beiser et al. | 260/458 R |
| 3,755,407 | 8/1973 | Wilkes | 260/459 |
| 3,959,186 | 5/1976 | Harris | 252/551 |
| 4,052,342 | 10/1977 | Fernley et al. | 252/541 |
| 4,224,195 | 9/1980 | Kawasaki et al. | 252/546 |
| 4,265,790 | 5/1981 | Winston et al. | 252/532 |

FOREIGN PATENT DOCUMENTS

| | | |
|---|---|---|
| 0135381 | 5/1979 | Fed. Rep. of Germany . |
| 52-22007 | 2/1977 | Japan . |

*Primary Examiner*—P. E. Wills, Jr.

[57] ABSTRACT

A process for the preparation of mixed ethoxylated alcohol/ethoxy sulfate surfactants, such surfactants, and detergent formulations incorporating the same. The mixed surfactants comprise a neutralized blend incorporating, in addition to the sulfated and unsulfated ethyoxylated alcohols, from 2 to 10% by weight unethoxylated alcohols and from 6 to 50% by weight unethoxylated alcohol sulfates in the proportions defined within the region ABCDE in the accompanying drawing.

10 Claims, 1 Drawing Figure

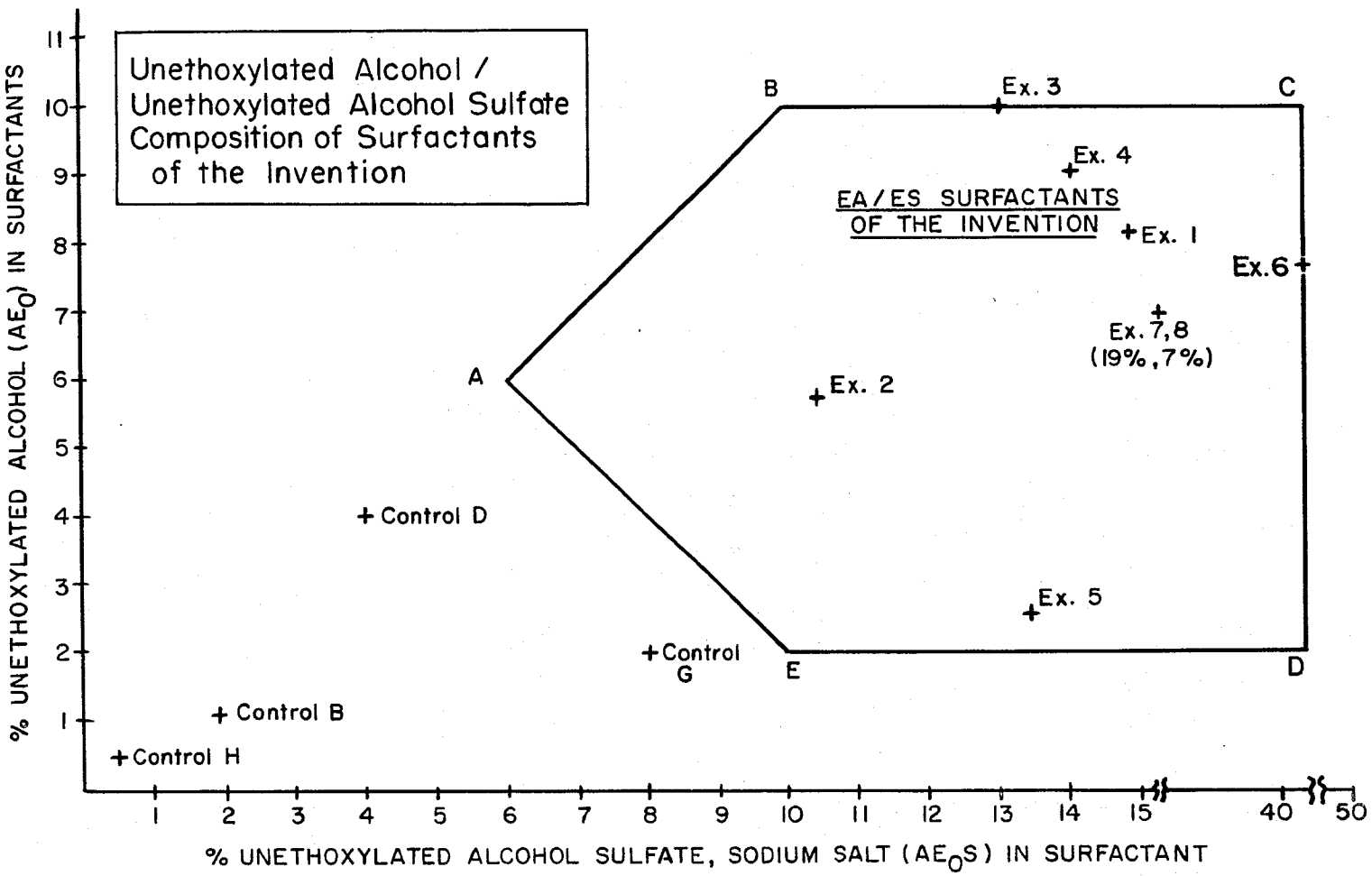
Unethoxylated Alcohol / Unethoxylated Alcohol Sulfate Composition of Surfactants of the Invention
EA/ES SURFACTANTS OF THE INVENTION
A
B
C
D
E
Ex. 1
Ex. 2
Ex. 3
Ex. 4
Ex. 5
Ex. 6
Ex. 7,8 (19%, 7%)
Control B
Control D
Control G
Control H
% UNETHOXYLATED ALCOHOL ($AE_0$) IN SURFACTANTS
% UNETHOXYLATED ALCOHOL SULFATE, SODIUM SALT ($AE_0S$) IN SURFACTANT

MIXED ETHOXYLATED ALCOHOL/ETHOXY SULFATE SURFACTANTS AND SYNTHETIC DETERGENTS INCORPORATING THE SAME

TECHNICAL FIELD

This invention relates to a process for the preparation of mixed ethoxylated alcohol/ethoxy sulfate surfactant systems, to the surfactants thus produced, and to synthetic detergent formulations incorporating the same. In particular, it relates to the preparation of ethoxylated alcohol/ethoxy sulfate surfactants providing low cost, low capital, low-energy intensive laundry detergents which exhibit both good cleaning and sudsing characteristics.

BACKGROUND ART

The manufacture and use of synthetic laundry detergents containing mixtures of nonionic and anionic surfactants has been documented in the patent literature. See, for example, Bonaparte et al. U.S. Pat. No. 3,920,586 granted Nov. 18, 1975. Moreover, the use of ethoxylated alcohols (referred to herein, for convenience, by the "EA" acronym) as the nonionic constituent of such mixtures, and ethoxy sulfates (referred to herein by the "ES" acronym) as the anionic constituent of such mixtures has also been described (see the aforesaid Bonaparte patent, column 2, lines 32–37; column 3, lines 17–28; column 9, lines 30–45; and column 9, line 67 column 10, line 20).

Dry blended laundry detergents containing such EA/ES or other nonionic/anionic surfactant systems are further described, for example, in Winston et al. U.S. application Ser. No. 65,203, entitled "METHOD OF PREPARING DRY BLENDED LAUNDRY DETERGENT", filed on Aug. 9, 1979, now U.S. Pat. No. 4,265,790 granted on May 5, 1981. In the past, however, when for cost purposes EA's have been utilized as the nonionic constituent of such surfactant systems, the sudsing characteristics of the resulting dry blended detergent formulations have been impaired. Moreover, the use of EA/ES surfactant systems in dry blended detergent powders has been said to interfere with the processing characteristics thereof. Various efforts have been made to improve such processing characteristics. See, for example, Kowalchuk U.S. Pat. No. 4,137,197 granted Jan. 30, 1979, and U.S. Pat. No. 4,162,994 granted Jul. 31, 1979.

It has also been suggested in the patent literature that EA/ES mixtures useful in detergent compositions may be prepared by the direct sulfation of various EA materials. See, for example, Roele U.S. Pat. No. 3,309,392 granted Mar. 14, 1967, and Harris U.S. Pat. No. 3,959,186 granted May 26, 1976. The Roele patent describes a two-stage, gas phase reaction for the sulfation of EA's having at least 8 carbon atoms with sulfur trioxide/inert gas mixtures. The final products, which are said to be useful as detergents, wetting agents or the like, are sulfated with conversions ranging from 87 to 97%.

The Harris patent, on the other hand, describes the sequential partial sulfation of, first, a highly ethoxylated EA (incorporating from 8 to 25 moles of ethoxylate per mole of the alcohol) and, thereafter, a less ethoxylated compound (incorporating from 2 to 12 moles of ethoxylate per mole of alcohol, but at least 4 ethoxylate groups per mole less than the EA first sulfated). Harris further discloses that, after neutralization of the partial sulfate mixture thus produced, the resulting product may contribute both detergent and builder properties to dry detergent formulations. Detergents incorporating the same are said to be capable of dispersing lime soap and to possess satisfactory washing characteristics as compared with other commercial dry powder detergents.

It is among the objects of the present invention to provide an improved process for the preparation of mixed EA/ES surfactants, which process may be efficiently and inexpensively carried out. A further object is to provide such surfactants, and detergents incorporating the same, which exhibit the detergency (cleaning) and esthetic (whiteness) characteristics required of commercial laundry detergents and which, moreover, have substantially improved sudsing characteristics.

These and other objects and advantages will be apparent from the following detailed description, taken in connection with the accompanying drawing partially illustrating the compositions of the neutralized, partially sulfated EA/ES surfactants of the present invention.

SUMMARY OF THE INVENTION

It has been found in accordance with this invention that improved EA/ES surfactants exhibiting good detergency and superior sudsing characteristics may be readily and inexpensively produced, without the use of special processing conditions or manufacturing equipment. Surfactants so useful are prepared by partially sulfating an initial mixture of (i) EA's having the formula $$R—O—(CH_2CH_2O)_nH,$$

wherein R is alkyl having a 12 to 18 carbon atom chain length, or alkylaryl (alkaryl) the alkyl moiety of which is 8–10 carbons, and n represents the average number of ethoxylate groups per molecule and is a number from 1 to 12; and (ii) alcohols R—OH (referred to herein for clarity as unethoxylated alcohols), wherein R is as defined hereinabove, the unethoxylated alcohols comprising from about 8 to 50% by weight of the mixture sulfated.

The initial mixture is partially sulfated, preferably to effect about 50 to 80% conversion to the corresponding sulfates, and thereafter neutralized to produce an EA/ES blend containing the unethoxylated alcohols in amounts of from about 2 to 10% by weight of the blend and the salts of the unethoxylated alcohol sulfate in amounts of from about 6 to 50% by weight of the blend, in the proportions defined within the region ABCDE in the accompanying drawing. Preferably, the neutralization is carried out simultaneously with admixing of the surfactant system with the further constituents of a detergent desirably formulated therewith.

In this manner EA/ES surfactants, and dry or liquid detergents incorporating the same, are directly and inexpensively prepared. The mode of preparation does not require separate purchase of the relatively expensive, pure ES materials. Nor does it impose high capital costs for specialized manufacturing equipment for handling oleum or sulfur trioxide, for example; hence, while oleum or sulfur trioxide may be utilized as a sulfating agent in the process hereof, the process is preferably carried out employing concentrated sulfuric acid. Nor does the present process require the use of special synthesis or formulating techniques; to the contrary, the EA/ES mixture is prepared in a single operation (successive reaction stages or sequential reactions of varying ethoxylates not being required), and is thereafter directly and simultaneously neutralized and mixed with additional detergent constituents (for example, in the case of dry detergents, by standard dry blending operations—not by spray drying or the like). Thus, the present process provides a markedly improved technique for the preparation of EA/ES surfactants and detergent formulations incorporating the same.

Moreover, there are thus provided mixed EA/ES surfactants which exhibit detergency characteristics equal or superior to those displayed by current, commercially available products. Similarly, the surfactant hereof exhibits physical and esthetic properties (e.g., in the case of dry powder detergents, particle flow and color characteristics) equal to those of current commercial products. Most important, the neutralized, partially sulfated EA/ES mixtures hereof provide better sudsing characteristics than exhibited by commercial detergent formulations based on the relatively low cost EA nonionic surfactants. In short, the neutralized, partially sulfated EA/ES surfactant provided in accordance herewith is relatively economical (since based upon the low cost EA nonionic surfactants) yet exhibits superior characteristics as compared with other EA-based surfactant systems, viz., detergency characteristics at least equal, and sudsing characteristics superior, to those exhibited by such formulations.

BRIEF DESCRIPTION OF THE DRAWING

The attached drawing is a graph illustrating the compositions of the present invention, the abscissa indicating the residual amounts of unethoxylated alcohol ($AE_0$) and the ordinate indicating the residual amounts of unethoxylated alcohol sulfate sodium salt ($AE_0S$) contained in the partially sulfated neutralized reaction mixture, in percents by weight thereof. The pentagonal area ABCDE in the drawing defines the composition of the EA/ES surfactant system of the invention.

PREFERRED EMBODIMENTS OF THE INVENTION

Ethoxylated alcohols which are partially sulfated in the practice of this invention have the formula $$R—O—(CH_2CH_2O)_nH$$

wherein R is a straight or branched chain alkyl group having from 12 to 18 carbon atoms, or an alkylaryl, e.g., alkyl benzene group, the alkyl moiety of which is a straight or branched chain containing from 8 to 10 carbon atoms, and n represents the average number of moles of ethoxylate per mole of the EA reactant and is generally from 1 to 12.

The unethoxylated alcohols admixed therewith for partial sulfation have corresponding formulas R—OH, wherein R is as defined hereinabove. The initial mixture of EA's and unethoxylated alcohols may, indeed, comprise the reaction mixture from the ethoxylation of one or a blend of the same alcohols R—OH.

The detergent range alcohols and EA's which may be so employed include both those derived from vegetable and animal oils and those produced from synthetic alcohol processes, e.g., the Ziegler and Oxo alcohol processes, the SHOP process, and by the oxidation of paraffins to secondary alcohols.

Unethoxylated alcohols which may be partially sulfated in the process hereof include coconut fatty alcohols, tallow fatty alcohols, and the commercially available long-chain fatty alcohol blends, e.g., the $C_{12}$ to $C_{15}$ alcohol blends available as Neodol 25 (Shell Chemical Company) and Tergitol 25L (Union Carbide Corporation), and the $C_{14}$ to $C_{15}$ alcohol blends available, for example, as Neodol 45 (Shell).

EA's which may thus be partially sulfated include the ethoxylated coconut alcohols, ethoxylated tallow alcohols, and the ethoxylated, mixed coconut and tallow fatty alcohols. Similarly, commercial blends of (1) the $C_{12}$ to $C_{15}$ fatty alcohols nominally ethoxylated with n moles of ethylene oxide per mole of the fatty alcohol (e.g., n=3, 7, 9, 11 and 12 for Neodol 25-3, 25-7, 25-9, 25-11 and 25-12, and for Tergitol 25-L-3, 25-L-7, 25-L-9, 25-L-11 and 25-L-12, respectively); or (2) the $C_{14}$–$C_{15}$ fatty alcohols nominally ethoxylated with m moles of ethylene oxide per mole of the fatty alcohol (e.g., m=1 and 3 for Neodol 45-1 or 45-3, respectively), may be so employed. Alternatively, alkylaryl-substituted EA's such as the commercially available blends of nonyl phenol nominally ethoxylated with 8, 8.5, 9 or 10 moles of ethylene oxide per mole of nonyl phenol (e.g., NP-8, 8.5, 9 and 10, respectively, available from Union Carbide), may be partially sulfated in the present process.

Whichever EA/unethoxylated alcohol mixture is reacted, in accordance with the invention it is desirable that the unethoxylated alcohols be present in the initial mixture in an amount of from about 8 to 50%, and preferably from about 10 to 25%, by weight thereof. As indicated more fully hereinafter, it is a prime finding of the present invention that surfactant systems exhibiting markedly superior sudsing characteristics may be obtained by maintaining particular proportions of the unethoxylated alcohols and unethoxylated alcohol sulfates in the neutralized, partially sulfated EA/ES product mixture. It is thus important that the specified proportions of the unethoxylated alcohols be provided in the initial mixture to assure the desired content of residual unethoxylated materials in the final product.

It is preferred to employ the commercial blends of $C_{12}$ to $C_{15}$ fatty alcohols nominally ethoxylated with three moles of ethylene oxide per mole of alcohol (i.e., Neodol 25-3 or Tergitol 25-L-3) as the initial EA/unethoxylated alcohol mixture to be sulfated in the process hereof. Typically, the unethoxylated alcohols comprise from about 15 to 25% by weight of commercial blends of this type; generally, from about 30 to 50 weight percent of the EA's in such commercial blends incorporate up to three ethoxy groups per mole of alcohol, the balance of the EA fractions thereof containing varying degrees of ethoxylation of up to as much as 14 ethoxy groups per mole. The nominal analysis, and the actual analysis of one batch of this type of blend useful in the process and compositions hereof were as follows:

TABLE I

NOMINAL AND ACTUAL ANALYSES OF PREFERRED BLENDS OF $C_{12}$–$C_{15}$ EA'S/ALCOHOLS

| n (Number of ethoxy Groups per EA) | Nominal Analysis (Weight %) | Actual Analysis (Weight %) |
|---|---|---|
| 0 | 16 | 23 |
| 1 | 11 | 14.5 |
| 2 | 12 | 16.4 |
| 3 | 12 | 13.6 |
| 4 | 11 | 10.3 |
| 5 | 9 | 7.2 |
| 6 | 6 | 4.4 |
| 7 | 5 | 3.2 |

TABLE I-continued

NOMINAL AND ACTUAL ANALYSES OF PREFERRED BLENDS OF $C_{12}$-$C_{15}$ EA'S/ALCOHOLS

| n (Number of ethoxy Groups per EA) | Nominal Analysis (Weight %) | Actual Analysis (Weight %) |
|---|---|---|
| 8 | 4 | 2.6 |
| 9 | 3 | 4.8 (n = 9+) |
| 10 | 3 | |
| 11 | 2 | |
| 12 | 1 | |
| 13 | 1 | |
| 14 | 1 | |

The EA/unethoxylated alcohol mixture is sulfated under conditions designed to maintain a predetermined proportion of the unethoxylated, unsulfated alcohols in the final, neutralized reaction product (from about 2 to 10% by weight of the neutralized mixture, as indicated hereinafter). The initial mixture is thus only partially sulfated, preferably such that from about 50 to 80% by weight of the ethoxylated and unethoxylated alcohol moieties are sulfated. For this purpose it is preferred to effect the partial sulfation with 96–100% concentrated sulfuric acid in the proportion of from about 1.0 to 2.0 moles of the acid per mole of the initial mixture, and to carry out the sulfation at relatively low temperatures, e.g., at temperatures of from about 120° to 180° F., and for periods of from about 1 to 60 minutes, to produce the desired, partially sulfated mixture.

Employing the preferred $C_{12}$ to $C_{15}$ blends of EA's and unethoxylated alcohols referred to hereinabove, best results are obtained by carrying out the partial sulfation with conversions to the sulfated materials of from about 50 to 65% by weight of the initial ethoxylated+unethoxylated alcohol moieties. In this most preferred embodiment, the initial mixture of alcoholic materials is desirably reacted with concentrated sulfuric acid in the proportion of from about 1.1 to 1.3 moles of acid per mole, and maintained at reaction temperatures of from 120° to 180° F. for periods of only from about 1 to 30 minutes.

It will be understood that the partial sulfation reaction may be carried out employing either batch or continuous operations. The specific reaction times and temperatures may be varied, depending upon the particular reaction system utilized and the specific degree of sulfation desired for any particular application. It will also be understood that, if desired, the sulfation reaction may be carried out employing oleum (20–30%), liquid or gaseous $SO_3$, or chloro-sulfonic acid as the partial sulfating agent in lieu of concentrated sulfuric acid. The use of the latter material is, however, preferred since it obviates the necessity to employ special manufacturing equipment which may be necessary for the safe-handling and environmental control of fuming sulfuric acid or like reactants.

It has been found that, when the partial sulfation technique is carried out as aforesaid and the neutralized reaction mixture contains residual unethoxylated alcohols in amounts of from about 2 to 10%, and unethoxylated alcohol sulfates in amounts of from about 6 to 50%, the proportions defined within the region ABCDE in the accompanying drawing, the resulting surfactant exhibits certain distinct advantages. In particular, as illustrated by a comparison of the detergency and sudsing characteristics exhibited by the EA/ES surfactant systems of Examples 1–8 and Controls A-H below, it may be seen that it is only when the partial sulfation reaction is carried out in the manner described hereinabove and the neutralized, sulfated mixture incorporates the residual amounts of unethoxylated alcohols and unethoxylated alcohol sulfates within the region ABCDE in the accompanying drawing, that detergent formulations exhibiting both good detergency and superior sudsing characteristics are obtained. Prior to the present invention, EA's incorporating relatively low degrees of ethoxylation, e.g., materials such as the above described blend of $C_{12}$ to $C_{15}$ EA's wherein from about 30 to 50% by weight of the EA constituents thereof incorporate from one to three moles of ethoxylate per mole of the alcohol, were generally regarded as relatively poor surfactants for detergent use. In accordance with this invention it has been discovered that when such a blend of EA's is partially sulfated within the parameters and in the proportions indicated hereinabove, the resulting neutralized, partially sulfated mixture exhibits both good detergency and sudsing characteristics.

It is preferred to produce the EA/ES blend by partial sulfation followed by neutralization as described more fully hereinabove. Alternatively, it is within the purview of the present invention to form the EA/ES surfactant blends utilized herein by mixinq the EA/unethoxylated alcohol mixtures with fully sulfated and neutralized mixtures.

Employing the partial sulfation technique, following sulfation the reaction mixture is neutralized in conventional manner with any desired base, e.g., with sodium hydroxide, soda ash, or other desired alkali metal or ammonium hydroxide or carbonate. Preferably, when the neutralized partially sulfated reaction mixture is to be utilized as the surfactant system in a dry powder detergent, the neutralization is effected simultaneously with dry blending of the surfactant with the further ingredients of the detergent formulation. Alternatively, the EA/ES reaction mixture may be separately neutralized with an appropriate base, and the neutralized material thereafter blended with the further detergent ingredients. In either case, it has been found that dry powder detergents may be formulated with the mixed EA/ES surfactant systems provided by the present invention utilizing only conventional dry blending equipment and operations, and without the necessity for spray drying or other relatively expensive processing treatments.

When thus incorporated in a dry blended detergent formulation, the neutralized, partially sulfated EA/ES surfactant hereof is desirably incorporated therein in proportions of from about 5 to 20% by weight thereof. Such formulations typically additionally contain one or more builder salts or compounds, alkali metal silicate corrosion inhibitors, and one or more further adjuvants such as pH buffering compounds, soil suspending agents, oxidizing agents, enzymes, optical brighteners, fillers, perfumes, coloring agents or the like.

The builder salts, which peptize soil and remove water hardness ions, include various inorganic phosphates, pyrophosphates, borates, carbonates, bicarbonates, sesquicarbonates, silicates and zeolites, and organic compounds including citrates, NTA or alkanolamines. Various organic amines may also be incorporated as suds builders, including alkanolamides, amine oxides and alkanolamines. The soil suspending agents include colloids such as carboxymethylcellulose, polyvinyl alcohol, or the like. Oxidizing agents which may be incorporated in such formulations for stain removal include the alkali metal perborates and percarbonates; enzymes such as the alkalases, proteases or the like can be added for similar purposes.

Those skilled in the art will recognize that any of the preceding or various other recognized detergent ingredients may be blended with the surfactants of this invention to provide useful dry blended detergent formulations. Such further ingredients are further disclosed, for example, in the aforesaid Winston et al. application, the pertinent disclosure of which is incorporated by this reference herein.

In like fashion, the preceding or other conventional detergent ingredients may be admixed with the surfactant hereof to provide liquid laundry detergent formulations. The neutralized, partially sulfated EA/ES surfactant is desirably admixed in such formulations in proportions of from about 25 to 55% by weight thereof. The liquid formulations may additionally include sequestrants, viscosity modifiers, and any of the various adjuvants noted hereinabove. Typical constituents of liquid detergent formulations which may be thus admixed with the surfactants of the present invention are disclosed, for example, in Collins U.S. Pat. No. 3,869,399 granted Mar. 4, 1975, the disclosure of which is additionally incorporated by this reference herein.

It is preferred to incorporate the novel surfactants hereof in dry blended detergents, particularly since the surfactant may be simultaneously neutralized and dry blended with the further ingredients of the formulation in standard batch or continuous powder mixing equipment. Preferably, dry detergent powders which may be thus formulated and which include the mixed EA/ES surfactant system thereof, comprise the following ingredients:

| | Typical Range | Preferred Range |
|---|---|---|
| Neutralized, mixed EA/ES surfactant | 5 to 20% | 6 to 9% |
| Light soda ash | 94 to 47% | 93 to 72% |
| Hydrous alkali metal silicate corrosion inhibitor | 0 to 8% | 0 to 4% |
| Sodium bicarbonate pH buffer | 0 to 20% | 0 to 10% |
| Miscellaneous adjuvants such as soil suspending agents, fabric whitening agents, perfume, sulfuric acid, water | 1 to 5% | 1 to 5% |

EXAMPLES

The following examples illustrate a number of preferred embodiments of the process for the preparation of the mixed EA/ES surfactants of the present invention, such surfactants, and detergent formulations incorporating the same. In the examples, as well as in the preceding description, all parts and percentages have been given by weight and all temperatures have been specified in degrees Fahrenheit, unless otherwise indicated. It will be understood that the examples are given for purposes of illustration only, and that the invention is not restricted thereto.

Example 1—Batch Preparation of EA/ES Surfactant and Dry Powder Detergent Incorporating the Same 736.6 grams of the above identified preferred commercial $C_{12}$ to $C_{15}$ EA/unethoxylated alcohol blend was charged to a 2 liter beaker. The EA/unethoxylated alcohol mixture incorporated 23% of the unethoxylated alcohols, about 45% of the EA's incorporating from one to three ethoxy groups per EA molecule, and the further fractions identified in Table I above. The number average molecular weight of the initial EA/unethoxylated alcohol blend was 335.

263.4 grams of 98% sulfuric acid was added to the initial mixture with agitation sufficient to produce top-to-bottom mixing without splashing. The initial mixture was about 75° F., the exothermic sulfation reaction increasing the reaction temperature to about 171° F. in one minute. After reaction for 30 minutes the reaction temperature had cooled to about 145° F. due to uncontrolled air cooling.

By thus carrying out the reaction, it was found that about 58% of the initial EA/unethoxylated alcohol mixture had been converted to the corresponding sulfated materials, the sulfated acid mixture containing 53% of the sulfated EA/unethoxylated alcohols, 31% EA/unreacted alcohols, 13% sulfuric acid and 3% water. Residual quantities of the unethoxylated alcohols in the amount of 8.2%, and the unethoxylated alcohol sulfates (expressed as the salt form) in the amount of 14.8%, were specifically found (see Table II below).

The partially sulfated acid mixture was thereafter combined in a 16 quart V-shell blender with further ingredients for the formulation of a dry powder detergent. The surfactant system was incorporated in such mixture at approximately an 8% level (4.6% of the sulfated EA/unethoxylated alcohol mixture, and 2.5% of the initial, unreacted (i.e., unsulfated) EA/unethoxylated alcohol mixture). The further constituents of the detergent formulation, the specific proportions of which are set forth in Table III below, consisted of light soda ash, hydrated sodium silicate, sodium bicarbonate, carboxymethyl cellulose, polyvinyl chloride, an optical brightener, and perfume.

The resulting detergent was white, free flowing and had good odor. When subjected to the detergency and sudsing tests described hereinafter, it exhibited good suds coverage and detergency characteristics in the wash, as further indicated in Table IV below.

Similar results were obtained when a different $C_{12}$ to $C_{15}$ EA/unethoxylated alcohol commercial blend (Tergitol 25-L-3), having a number average molecular weight of 341, was similarly treated and blended with a dry detergent formulation.

Example 2—Continuous Preparation of EA/ES Surfactant and Dry Powder Detergent Incorporating the Same 9.8 gallons per minute of the same $C_{12}$ to $C_{15}$ EA/unethoxylated alcohol blend reacted in Example 1 was continuously mixed with 98% sulfuric acid at 1.75 gallons per minute in a 300 gallon continuous stirred tank reactor. The reactor was maintained at a temperature of about 135° F., the reaction mixture being removed after 30 minutes residence time within the reactor and discharge piping. The resulting acid mixture was fed at a 10 gpm rate to a 75 ft. V-shell blender incorporating the further detergent ingredients specified in Table III.

The surfactant thus prepared had substantially the same composition, and was incorporated in the detergent formulation in substantially the same proportions, as the surfactant prepared as described in Example 1. Thus, the neutralized surfactant incorporated about 4.6% of the sulfated EA/unreacted alcohol materials. The final detergent formulation was white, free-flowing and had good odor. Moreover, it exhibited suds coverage and cleaning characteristics substantially the same as those exhibited by the formulation of Example 1.

Examples 3–8—Miscellaneous Batch Preparations of EA/ES Surfactants, and Detergent Formulations Incorporating the Same A number of further surfactants was prepared, utilizing the procedure described in Example 1, or by admixing the various reactants, the ingredients being employed in the proportions indicated in Tables II and III.

In Examples 3 and 4, the same $C_{12}$–$C_{15}$ commercial blend utilized in Example 1 (Neodol 25-3) was employed as the initial mixture subjected to partial sulfation.

In Example 5, a fully sulfated and neutralized blend of the $C_{12}$–$C_{15}$ EA/unethoxylated alcohol of Example 1 was purchased commercially and admixed with the $C_{12}$–$C_{15}$ EA/unethoxylated alcohol of Example 1 in the weight ratio of 6.0 to 1.2.

The $C_{12}$–$C_{15}$ EA/unethoxylated alcohol used contained 16% unethoxylated alcohol. The EA content thereof consisted of 35% of materials incorporating from one to three ethoxy groups per molecule.

In Example 6, a fully sulfated and neutralized blend of $C_{14}$–$C_{15}$ EA/unethoxylated alcohol, nominally ethoxylated with 1 mole ethylene oxide, was mixed with the $C_{14}$–$C_{15}$ EA/unethoxylated blend (Neodol 45-1) in the proportions of 6.0 to 1.1.

The $C_{14}$–$C_{15}$ EA/unethoxylated alcohol contained about 50% unethoxylated alcohol. The EA content thereof consisted of about 50% of materials incorporating from one to three ethoxy groups per molecule.

In Example 7, fully neutralized and sulfated blends of Neodol 45-1 and Neodol 25-12 (nominally ethoxylated with 12 moles of ethylene oxide) were mixed with the unsulfated Neodol 45-1 and Neodol 25-12 materials in the proportion of 37.5:12.5:12.5:37.5 parts, respectively.

In Example 8, fully neutralized and sulfated blends of Neodol 45-13 and Neodol 45-1 were mixed with the unsulfated Neodol 45-13 and 45-1 materials in the proportion of 12.5:37.5:37.5:12.5 parts, respectively.

The proportions of the reactants utilized to prepare the mixed EA/ES surfactant systems with these initial mixtures and the residual portions of unethoxylated materials in the resulting surfactants are set out in Table II below; similarly, the further ingredients in the detergent formulations incorporating such surfactants are set forth in Table III below. Finally, the detergency and sudsing characteristics exhibited by the respective detergents are tabulated in Table IV.

Control Detergent Formulations A–H

The various control detergents were prepared to compare the detergency and sudsing characteristics of formulations incorporating a conventional anionic/nonionic surfactant (Control A), and surfactants incorporating other EA/ES mixtures (Controls B–H), with the compositions of the invention. In each instance, the surfactant was blended with the further detergent ingredients in the proportion of about 7% by weight thereof. The specific materials employed in the surfactant systems of the various control formulations were as follows:

Control A was a detergent incorporating 6% of the conventional anionic surfactant LAS (a linear alkyl benzene sulfonate in which the average alkyl chain length is about 12 carbon atoms) with 3% of the aforesaid $C_{12}$ to $C_{15}$ EA/unethoxylated alcohol blend of nonionic surfactants (Neodol 25-3). The surfactant system was incorporated as such in the detergent formulation, without sulfation.

In Control B, a $C_{12}$ to $C_{15}$ EA/unethoxylated alcohol blend, nominally ethoxylated with 7 moles of ethylene oxide per mole of alcohol (Neodol 25-7) was partially sulfated in accordance with the conditions employed in Example 1. The initial mixture nominally contained only about 3% of the unethoxylated alcohols, whereas about 11% of the EA content thereof consisted of materials incorporating from one to three ethoxy groups per molecule.

In Control C, four commercially made surfactant ingredients were blended in the following proportions:

- 25 parts fully sulfated and neutralized $C_{12}$–$C_{15}$ unethoxylated alcohol,
- 25 parts fully sulfated and neutralized $C_{12}$–$C_{15}$ EA/unethoxylated alcohol blend, nominally ethoxylated with 12 moles ethylene oxide,
- 25 parts of the $C_{12}$–$C_{15}$ unethoxylated alcohol (Neodol 25), and
- 25 parts of the $C_{12}$–$C_{15}$ unethoxylated alcohol blend, nominally ethoxylated with 12 moles ethylene oxide (Neodol 25-12).

In Controls D–H, mixtures were prepared of sulfated and unsulfated commercial EA/unethoxylated alcohol blends, in the same manner as described above in connection with Control C. The individual constituents and the respective proportions thereof are set forth in Table II below.

The various control blends were incorporated as surfactants in detergent formulations as set out in Table III below. The detergency and sudsing characteristics thereof are compared with the like characteristics of the formulations of Examples 1–8 in Table IV.

TABLE II

PREPARATION OF EA/ES SURFACTANTS

| | Ex. 1 | Ex. 2 (gpm) | Ex. 3 | Ex. 4 | Ex. 5 | Ex. 6 | Ex. 7 | Ex. 8 |
|---|---|---|---|---|---|---|---|---|
| Sulfation Reactants (Parts) | | | | | | | | |
| Sulfuric Acid (98%) | 263.4 | 1.75 | 224.6 | 241.9 | | | | |
| Neodol 25-3 | 736.6 | 9.8 | 673.2 | 668.4 | | | | |
| Neodol 25-7 | | | | | | | | |
| Total Acid mixture | 1000 | 11.55 | 897.8 | 910.3 | | | | |
| Surfactants by Admixture | | | | | | | | |
| Sulfated, Neutralized Neodol 25 | | | | | | | | |
| Sulfated, Neutralized Neodol 25-3 | | | | | 83.9 | | | |
| Sulfated, Neutralized Neodol 25-7 | | | | | | | | |
| Sulfated, Neutralized Neodol 45-1 | | | | | | 84.7 | 37.5 | 37.5 |
| Sulfated, Neutralized Neodol 25-12 | | | | | | | 12.5 | |

TABLE II-continued

PREPARATION OF EA/ES SURFACTANTS

| | | | | | | | | |
|---|---|---|---|---|---|---|---|---|
| Sulfated, Neutralized Neodol 45-13 | | | | | | | | 12.5 |
| Neodol 25 | | | | | 16.1 | | | |
| Neodol 25-3 | | | | | | | | |
| Neodol 25-7 | | | | | | 15.3 | 12.5 | 12.5 |
| Neodol 45-1 | | | | | | | 37.5 | |
| Neodol 25-12 | | | | | | | | 37.5 |
| Neodol 45-13 | | | | | | | | |
| Total Surfactant Mixture | | | | | 100 | 100 | 100 | 100 |
| Composition | | | | | | | | |
| % Unethoxylated Alcohol Before Sulfation | 23 | 16 | 23 | 23 | 16 | 50 | 26 | 26 |
| % $AE_{1-3}$ Before Sulfation[1] | 44.5 | 35 | 44.5 | 44.5 | 35 | 50 | 27 | 27 |
| % $AE_0$, Sulfated, Neutralized Mixture[2] | 8.2 | 5.7 | 10.0 | 9 | 2.6 | 7.7 | 7 | 7 |
| % $AE_0$, Sulfated, Neutralized Mixture[3] | 14.8 | 10.3 | 13.0 | 14 | 13.4 | 42.4 | 19 | 19 |

| | Control B | Control C | Control D | Control E | Control F | Control G | Control H |
|---|---|---|---|---|---|---|---|
| Sulfuric Acid (98%) | 238.2 | | | | | | |
| Neodol 25-3 | | | | | | | |
| Neodol 25-7 | 1196 | | | | | | |
| Total Acid Mixture | 1434.2 | | | | | | |
| Surfactants by Admixture | | | | | | | |
| Sulfated, Neutralized Neodol 25 | | 25 | | | | 50 | |
| Sulfated, Neutralized Neodol 25-3 | | | 25 | | | | |
| Sulfated, Neutralized Neodol 25-7 | | | | | | | |
| Sulfated, Neutralized Neodol 45-1 | | | | 16.7 | 25 | | |
| Sulfated, Neutralized Neodol 25-12 | | 25 | 25 | 16.7 | | | 50 |
| Sulfated, Neutralized Neodol 45-13 | | | | | 25 | | |
| Neodol 25 | | 25 | | | | | |
| Neodol 25-3 | | | 25 | | | | |
| Neodol 25-7 | | | | | | 50 | |
| Neodol 45-1 | | | | 33.3 | 25 | | |
| Neodol 25-12 | | 25 | 25 | 33.3 | | | 50 |
| Neodol 45-13 | | | | | 25 | | |
| Total Surfactant Mixture | | 100 | 100 | 100 | 100 | 100 | 100 |
| Composition | | | | | | | |
| % Unethoxylated Alcohol Before Sulfation | 3 | 51 | 8 | 50 | 26 | 52 | 1 |
| % $AE_{1-3}$ Before Sulfation[1] | 11 | 2 | 20 | 26 | 27 | 7 | 4 |
| % $AE_0$ Sulfated, Neutralized Mixture[2] | 1.1 | 25 | 4 | 17 | 13 | 2 | 0.5 |
| % $AE_0$ Sulfated, Neutralized Mixture[3] | 1.9 | 25 | 4 | 9 | 13 | 8 | 0.5 |

Footnotes to Table II
[1]Percentage of EA's having from one to three ethoxylate groups per mole in the initial mixture reacted.
[2]Percentage of unethoxylated alcohols in the neutralized EA/ES surfactant mixture.
[3]Percentage of EA sulfates, expressed as the alkali metal salts thereof, in the neutralized EA/ES surfactant mixture.

The percentages of unethoxylated and ethoxylated materials in the initial and sulfated, neutralized mixtures were calculated, based upon the actual analysis of the Neodol 25-3 blend reacted in Examples 1, 3 and 4, and upon the manufacturers nominal analyses of the various blends reacted in Examples 2, 5–8 and Controls B–H above.

TABLE III

DETERGENT FORMULATIONS

| Detergent Ingredients (Parts) | Ex. 1 | Ex. 2 | Ex. 3 | Ex. 4 | Ex. 5 | Ex. 6 | Ex. 7 | Ex. 8 |
|---|---|---|---|---|---|---|---|---|
| Surfactant Acid Mixture | 817.5 | 266 | 898 | 910 | | | | |
| Surfactant Mixture of Table II | | | | | 7.1 | 7.1 | 6.9 | 6.9 |
| Light Soda Ash | 8278 | 2690 | 8923 | 8911 | 79.6 | 79.6 | 79.7 | 79.7 |
| Hydrated Sodium Silicate | 308 | 100 | 846 | 846 | 7.3 | 7.3 | 7.3 | 7.3 |
| Sodium Bicarbonate | 502 | 163 | 568 | 568 | 5.0 | 5.0 | 5.0 | 5.0 |
| Carboxymethyl Cellulose | 33.8 | 11 | 38 | 38 | 0.34 | 0.34 | 0.34 | 0.34 |
| Polyvinyl Alcohol | 33.8 | 11 | 38 | 38 | 0.34 | 0.34 | 0.34 | 0.34 |
| Optical Brightener | 18.2 | 6 | 30 | 30 | 0.18 | 0.18 | 0.18 | 0.18 |
| Perfume | 10.7 | 3 | 11 | 11 | 0.19 | 0.19 | 0.19 | 0.19 |
| Total | 10002 | 3250 | 11352 | 11352 | 100 | 100 | 100 | 100 |
| % Sulfated Surfactant | 4.6 | 4.6 | 4.1 | 4.3 | 6.0 | 6.0 | 3.45 | 3.45 |
| % Nonionic Surfactant | 2.6 | 2.5 | 3.1 | 3.0 | 1.2 | 1.1 | 3.45 | 3.45 |

| Detergent Ingredients (Parts) | Control A | Control B | Control C | Control D | Control E | Control F | Control G | Control H |
|---|---|---|---|---|---|---|---|---|
| Neodol 25-3 | 3.0 | — | — | — | — | — | — | — |
| Sodium LAS | 6.0 | — | — | — | — | — | — | — |
| Surfactant Acid Mixture | — | 762.5 | — | — | — | — | — | — |
| Surfactant Mixture of Table II | — | — | 6.9 | | | | | |
| Light Soda Ash | 59.9 | 9608 | 79.7 | | | | | |
| Sodium Sesquicarbonate | 18.0 | — | — | | | | | |
| Hydrated Sodium Sulfate | 6.8 | 862 | 7.3 | | | | | |
| Sodium Bicarbonate | 5.7 | — | 5.0 | | | | | |

The detergent [formulation] in each of controls D–H was the same as

TABLE III-continued

| DETERGENT FORMULATIONS | | | | | | | | |
|---|---|---|---|---|---|---|---|---|
| Carboxymethyl Cellulose | 0.15 | 38 | 0.34 | | | in Control C. | | |
| Polyvinyl Alcohol | 0.15 | 38 | 0.34 | | | | | |
| Optical Brightener | 0.13 | 30 | 0.18 | | | | | |
| Perfume | 0.09 | 11 | 0.19 | | | | | |
| Total | 100 | 11349.5 | 100 | | | | | |
| % Sulfated Surfactant | 6.0 | 4.6 | 3.45 | 3.45 | 1.3 | 3.45 | 3.45 | 3.45 |
| % Nonionic Surfactant | 3.0 | 2.6 | 3.45 | 3.45 | 4.6 | 3.45 | 3.45 | 3.45 |

Comparison of Detergency and Sudsing Characteristics of the Detergents of Examples 1–8 with the Detergents of Controls A–H A. Detergency Tests The detergency characteristics of the respective detergent formulations were compared by staining cotton and polyester/cotton fabrics with oily and clay-like deposits, and determining the degree of detergency relative to that achieved by the Control A formulation incorporating the LAS (anionic)/EA-unethoxylated alcohol surfactant system.

The relative detergencies were determined by measuring the reflectance characteristics of standard fabric samples (oil on cotton [ACH-120 from ACH Fiber Service, Inc.]; oil on polyester/cotton [EMPA-104 from Test Fabrics, Inc.]; and clay on cotton and clay on polyester/cotton [from Scientific Services Inc.]) before and after a standard washing cycle in a "terg-o-tometer" (at 100° F., 150 ppm hardness, for 10 minutes). The differences in reflectivities were compared with those exhibited by the Control A formulation, those products having greater reflectance values (and hence exhibiting greater detergency) being rated by positive values in the following tabulation (Table IV).

B. Sudsing Tests

The sudsing characteristics of the respective detergent formulations were assessed by comparison of either (a) the suds height, or (b) the percentage of the surface area of suds coverage in standardized tests employing G.E. domestic agitator-type washing machines. Both measurements were made with 100° F., 85 ppm hardness water. The suds height measurements were made on duplicate runs after 12 minutes of washing. The surface area coverage measurements were made after one minute of washing on eight individual runs, the results being averaged.

The suds heights and percentage coverages were determined in individual washing tests comparing the sudsing characteristics of Control A with each of the other detergent formulations. The sudsing exhibited by the several formulations was expressed as the absolute suds heights, and the incremental % of suds coverage relative to that exhibited by the Control A formulation.

The comparative detergency and sudsing characteristics of the detergent formulations of Examples 1–8 and Controls A–H are set out in Table IV, as follows:

TABLE IV

| DETERGENCY AND SUDSING CHARACTERISTICS OF TEST SAMPLES | | | | | | |
|---|---|---|---|---|---|---|
| | Comparative Detergency | | | | Comparative Sudsing | |
| Test Sample | Oil On Cotton | Oil On Polyester/Cotton | Clay On Cotton | Clay On Polyester/Cotton | Suds Height (cm.) | Suds Coverage (%) |
| Example 1 | −0.4 | +3.7 | +0.3 | −0.4 | 12–13.5 | +19 |
| Example 2 | +0.7 | +3.2 | +0.8 | +0.5 | — | +17.3 |
| Example 3 | −0.9[a] | +2.7[a] | −0.4[a] | +0.5[a] | 11.4 | +11[a] |
| Example 4 | −0.6[a] | +2.8[a] | −0.5[a] | +0.2[a] | 11.8 | +9.8[a] |
| Example 5 | — | — | — | — | 14 | +23.6 |
| Example 6 | — | — | — | — | 16 | — |
| Example 7 | — | — | — | — | 13 | — |
| Example 8 | — | — | — | — | 12 | — |
| Control A | BASE | BASE | BASE | BASE | 8–12 | BASE |
| Control B | −0.1 | +2.8 | +0.2 | 0 | 4 | +4 |
| Control C | | | | | 9–10 | — |
| Control D | | | | | 6.5 | — |
| Control E | | | | | 5.5 | — |
| Control F | | | | | 8.5 | — |
| Control G | | | | | 6.5 | — |
| Control H | | | | | 4.0 | — |

[a]Average of two data points.

As may be seen from a comparison of the data set forth in Table IV with the plot of the residual unethoxylated alcohol/unethoxylated alcohol sulfate salt content of the surfactant systems in the respective detergent formulations, those surfactants within plot ABCDE in the drawing exhibit detergency properties which are at least the equal of comparable commercial formulations (e.g., Control A) and sudsing properties which are markedly superior to both such commercial formulations and detergents incorporating other EA/ES surfactant systems (Controls B–H). As illustrated in the drawing, the EA/ES detergents of the invention which exhibit these properties thus incorporate from about 2 to 10 weight % of the residual unethoxylated alcohol and at least 6% and up to about 50% (in order to maintain the desirable properties of the ethoxylated materials as well) of the unethoxylated alcohol sulfates, expressed as the alkali metal salts thereof, as defined within region ABCDE thereon.

It will be understood that various changes may be made in the specific techniques and compositions described hereinabove for preparing the surfactants and detergents hereof without departing from the scope of the invention. Accordingly, the preceding description is intended as illustrative only, the scope of the invention being determined solely by the claims appended hereto.

We claim:

1. A process for the preparation of mixed ethoxylated alcohol/ethoxy sulfate surfactant, which comprises:

(a) contacting with concentrated sulfuric acid an initial mixture of (i) ethoxylated alcohols having the formula $$R—O—(CH_2CH_2O)_nH,$$

wherein R is alkyl having from 12 to 18 carbon atoms, or alkylaryl the alkyl moiety of which has from 8 to 10 carbon atoms, and n represents the average number of ethoxylate groups in said alcohols and is a number from 1 to 12; and (ii) unethoxylated alcohols R—OH, wherein R is as defined hereinabove, said unethoxylated alcohols comprising from 8 to 50% by weight of the initial mixture, so as to partially sulfate from about 50 to 80% by weight of the ethoxylated and unethoxylated alcohol moieties; and (b) neutralizing the partially sulfated mixture to produce a neutralized mixture containing an ethoxylated alcohol/ethoxy sulfate blend with the unethoxylated alcohols in an amount of from 2 to 10% by weight of the neutralized mixture and the unethoxylated alcohol sulfates in the salt form in an amount of from 6 to 42.4% by weight of the neutralized mixture, in the proportions defined within the pentagonal region ABCDE in the accompanying drawing.

2. The process of claim 1, wherein the mixture of ethoxylated alcohols and unethoxylated alcohols is sulfated with 96–100% concentrated sulfuric acid in the proportion of from 1.0–2.0 moles of sulfuric acid per mole of said mixture.

3. The process of claim 1, wherein the initial mixture of ethoxylated alcohols and unethoxylated alcohols is sulfated at temperatures of from 120° to 180° F. and for periods of from 1 to 60 minutes to produce the partially sulfated mixture.

4. The process of claim 1, wherein the partially sulfated mixture is simultaneously neutralized and dry blended with the further constituents of a synthetic detergent to form a dry powder synthetic detergent.

5. The process of claim 1, wherein the R groups of said ethoxylated alcohols and unethoxylated alcohols are alkyl chains of from 12 to 15 carbon atoms; in which said unethoxylated alcohols comprise from 10 to 25% by weight of the initial mixture, and from 30 to 50% by weight of the ethoxylated alcohols in said mixture incorporate from one to three moles of ethoxylate per mole of ethoxylated alcohols.

6. An ethoxylated alcohol/ethoxy sulfate surfactant, comprising a neutralized, partially sulfated mixture of:

(i) ethoxylated alcohols having the formula $$R—O—(CH_2CH_2O)_nH,$$

wherein R is alkyl having from 12 to 18 carbon atoms, or alkylaryl the alkyl moiety of which has from 8 to 10 carbon atoms, and n represents the average number of ethoxylate groups in said alcohols and is a number from 1 to 12; and (ii) unethoxylated alcohols R—OH, wherein R is as defined hereinabove;

from about 50 to 80% by weight of the ethoxylated and unethoxylated alcoholic materials in the mixture being sulfated and neutralized, and containing an ethoxylated alcohol/ethoxy sulfate blend with the unethoxylated alcohols in an amount of from 2 to 10% by weight of the mixture and the unethoxylated alcohol sulfates in the salt form in an amount of from 6 to 42.4% by weight of the mixture in the proportions defined within the pentagonal region ABCDE in the accompanying drawing.

7. The surfactant of claim 6, wherein the R groups of said ethoxylated and unethoxylated alcohols are alkyl chains having from 12 to 15 carbon atoms, in which said unethoxylated alcohols comprise from 10 to 25% by weight of said mixture, and in which from 30 to 50% by weight of said ethoxylated alcohols in said mixture incorporate from one to three moles of ethoxylate per mole of ethoxylated alcohols.

8. In a synthetic detergent, the improvement in which the surfactant system comprises a neutralized, partially sulfated mixture of:

(i) ethoxylated alcohols having the formula $$R—O—(CH_2CH_2O)_nH,$$

wherein R is alkyl having from 12 to 18 carbon atoms, or alkylaryl the alkyl moiety of which has from 8 to 10 carbon atoms, and n represents the average number of ethoxylate groups in said alcohols and is a number from 1 to 12; and (ii) unethoxylated alcohols R—OH, wherein R is as defined hereinabove;

from about 50 to 80% by weight of the ethoxylated and unethoxylated alcoholic materials in the mixture being sulfated and neutralized, and containing an ethoxylated alcohol/ethoxy sulfate blend with the unethoxylated alcohols in an amount of from 2 to 10% by weight of the mixture and the alkali metal salts of the unethoxylated alcohol sulfates in an amount of from 6 to 42.4% by weight of the mixture, in the proportions defined within the pentagonal region ABCDE in the accompanying drawing.

9. The synthetic detergent of claim 8, wherein the R groups of said ethoxylated and unethoxylated alcohols are alkyl chains having from 12 to 15 carbon atoms, in which said unethoxylated alcohols comprise from 10 to 25% by weight of said mixture, and in which from 30 to 50% by weight of said ethoxylated alcohols in said mixture incorporate from one to three moles of ethoxylate per mole of the ethoxylated alcohols.

10. The synthetic detergent of claim 8, comprising a dry powder detergent further including a builder component and an alkali metal silicate corrosion inhibitor.

* * * * *

UNITED STATES PATENT AND TRADEMARK OFFICE

CERTIFICATE OF CORRECTION

PATENT NO. : 4,464,292

DATED : August 7, 1984

INVENTOR(S) : Stephen P. Lengyel, et al.

It is certified that error appears in the above—identified patent and that said Letters Patent is hereby corrected as shown below:

On the cover page of the patent add the following:

Coinventor: -- Francis R. Cala, Highland Park, New Jersey 08904 --.

Assignee: Church & Dwight Co., Inc., Piscataway, New Jersey

Signed and Sealed this

*Second* Day of *April 1985*

[SEAL]

*Attest:*

DONALD J. QUIGG

*Attesting Officer*

*Acting Commissioner of Patents and Trademarks*